US006944550B2

(12) United States Patent
Marchetti

(10) Patent No.: US 6,944,550 B2
(45) Date of Patent: Sep. 13, 2005

(54) METHOD FOR TENSIONING MULTIPLE-STRAND CABLES

(76) Inventor: Michel Marchetti, 25bis rue Eugene Sue, Rueil-Malmaison (FR), F-92500

( * ) Notice: Subject to any disclaimer, the term of this patent is extended or adjusted under 35 U.S.C. 154(b) by 298 days.

(21) Appl. No.: 10/363,910

(22) PCT Filed: Sep. 6, 2001

(86) PCT No.: PCT/FR01/02775

§ 371 (c)(1),
(2), (4) Date: Mar. 10, 2003

(87) PCT Pub. No.: WO02/20904

PCT Pub. Date: Mar. 14, 2002

(65) Prior Publication Data

US 2004/0094651 A1 May 20, 2004

(30) Foreign Application Priority Data

Sep. 8, 2000 (FR) ..... 00 11476

(51) Int. Cl.[7] ..... G06F 19/00; G01M 5/00

(52) U.S. Cl. ..... 702/42; 702/41; 73/786; 242/410

(58) Field of Search ..... 702/42, 41, 43; 73/786, 760, 781, 788, 785; 242/710

(56) References Cited

U.S. PATENT DOCUMENTS 2,328,364 A * 8/1943 Taylor ..... 73/862.42
5,083,469 A * 1/1992 Percheron et al. ..... 73/862.42
5,176,334 A * 1/1993 Dreschau et al. ..... 242/413.3
5,809,710 A * 9/1998 Jungwirth et al. ..... 52/223.1

* cited by examiner

*Primary Examiner*—Patrick J. Assouad
(74) *Attorney, Agent, or Firm*—Young & Thompson

(57) ABSTRACT

A method whereby the strands (13,13A) are fixed one after another between two cable anchors (A,B) integral with the structure. The method consists: in pulling on one of the ends of a strand (13A) from one (A) of the cable anchors, while the other end is fixed on the other cable anchor (B); continuously testing the tensioning condition of the strand (13A), the condition involving in particular the measured values of the strand tension and of a predetermined parameter. The invention is characterized in that the predetermined parameter is the variation of the distance separating the cable anchors (A,B).

12 Claims, 4 Drawing Sheets

METHOD FOR TENSIONING MULTIPLE-STRAND CABLES

CROSS REFERENCE TO RELATED APPLICATION

This is the 35 USC 371 national stage of International Application PCT/FR01/02775 filed on Sep. 6, 2001, which designated the United States of America.

FIELD OF THE INVENTION

The present invention relates to a method for tensioning multiple-strand cables.

Multiple-strand cables can be used in all sorts of civil engineering structures, in particular to support structural members with a long span (bridge decks, stadium roofs) or to stabilize slender structures (for example microwave towers).

Be this as it may, in these types of civil engineering structures, it is necessary to tension the strands of a cable so that:

a) firstly, the total tension in a cable is uniformly distributed between all of the component strands, to prevent dangerous excess tensions in some strands, leading in particular to the risk of rupture by fatigue, b) secondly, the tension in the cable as a whole is adjusted to a value as close as possible to the theoretical value determined when the structure is designed.

BACKGROUND OF THE INVENTION

FR 2 652 866 describes a method of tensioning a multiple-strand cable which ensures a uniform distribution of the tension between all of the strands (see item a) above). In this method, the first strand, referred to as a witness strand, is installed and tensioned first, and is then anchored and provided with a measuring cell which indicates the tension in the witness strand at all times during installation of the cable. A second strand is then installed, progressively tensioned, and anchored at the precise moment that the tension in it is equal to that in the witness strand. The same procedure is followed for the third strand: it is introduced into the cable and then progressively tensioned until its tension is equal to that of the witness strand. This process continues until the last strand has been tensioned and anchored. The tension in the witness strand is then released, the measuring cell is removed, and the witness strand is then tensioned again to the final tension indicated by the cell.

Consequently, each time that a new strand is introduced into the cable, its tension is set relative to that of the witness strand; the two tensions, which are equal at the time the new strand is anchored, remain equal because they vary in the same manner afterward if the relative position of the cable anchors changes:

a) either because of a progressive increase in the tension in the cable as the strands are installed, b) or because of an external load applied to the structure.

This method, which is known as the isotension method, therefore enables all of the strands of a cable to be installed with an a priori guarantee of uniform distribution of the total force in the cable between all the strands.

It has a number of drawbacks, however.

First of all, the tensions in the new strand and the witness strand remain equal only if the two strands were at the same temperature at the moment of anchoring the new strand. Experience shows that this is not always the case: the witness strand is contained in a sheath exposed to sunlight and its temperature can be several tens of degrees higher than that of the new strand being installed. When the temperatures have equalized, a relative difference in the values of the tensions in the strands is then observed, and can exceed 10%. This sometimes requires a retensioning operation, using the method described, to equalize the tensions in the strands, and this represents additional work.

Moreover, although the prior art method imposes the same tension in all the strands at the time of installing the cable, the problem of adjusting a cable in accordance with the specifications imposed by the design of the structure remain outside the scope of the prior art method.

One approach that might be envisaged consists of using stiffness characteristics of the structure to which the cable is fixed to compute the tension to be applied to the first strand so that at the end of the installation of the strands the tension in the cable reaches a specific total. However, experience shows that this approach is imprecise, because of uncertainties as to the real load on the first strand, such as the real conditions of contact of the sheath, the presence of end tubes temporarily supported by the strand, etc. In practice, this problem is overcome by proceeding in two stages:

- the strands are initially installed as previously described at a fraction of the final tension (from 60% to 90%, depending on the project),
- appropriate means are then used to compute the stretch to be imparted to all of the strands to achieve the final tension, this computation yielding reliable results since it is reasonable to assume that the weight of the sheath is uniformly distributed between all of the strands; the calculated stretch is then usually applied to the witness strand, after which the other strands are retensioned using the isotension method.

It is obvious that this two-fold process greatly complicates the work and therefore increases the cost associated with installing and adjusting a cable.

Finally, the prior art method requires the tension in the witness strand to be released at the end of the work, followed by demounting the measuring cell and retensioning the witness strand to the previously measured tension; this also complicates the work.

SUMMARY OF THE INVENTION

An object of the invention is to provide a method of tensioning a multiple strand cable that is free of the drawbacks of the prior art technique.

The invention therefore provides a method of tensioning a multiple strand cable in which said strands are installed one after the other between two cable anchors fastened to the structure, the method consisting of:

- pulling on one end of a strand from one of the cable anchors with the other end fixed to the other cable anchor,
- measuring continuously the value of the tension in the strand, and
- continuously testing a condition for ending tensioning for the strand, said condition employing an expression that is a function of a predetermined parameter,
- which method is characterized in that said predetermined parameter is the variation in the distance between said cable anchors.

Thanks to the above features, it becomes possible:

- to ensure a uniform distribution of the total tension in the cable between all the strands, even if they are at different temperatures during installation, to impose on the cable as a whole a tension as close as possible to that specified when the structure is designed, even if the real loading conditions for the structure differ from those allowed for in the computations for the phase concerned, and to eliminate the intermediate stages of retensioning strands imposed by the prior art technique.

According to other advantageous features of the invention, the method further consists in:

a) determining the theoretical value of the zero tension length of the cable as a function of:

the total number of strands of the cable, the axial stiffness and the weight per unit length of each of the strands of the cable, the theoretical position of the cable anchors as defined by the drawings of the structure, the tension in the cable and the displacements of the cable anchors predicted by the design computations for the structure for a predetermined reference phase occurring after tensioning the cable, b) evaluating the initial displacements of the cable anchors immediately before installing the first strand of the cable, c) during the tensioning of each strand of the cable:

measuring continuously said distance variation from the step b), executing a computation loop to test continuously the condition for ending tensioning the strand, using said expression which is a function of said predetermined parameter, and d) locking the strand being tensioned to the cable anchor as soon as the condition for ending tensioning of the strand is satisfied.

There are essentially two embodiments of a method according to the invention.

In a first embodiment: said expression which is a function of said predetermined parameter defines the stretch remaining to be applied to the strand until the condition for ending tensioning is satisfied.

In this case, said expression can be defined by the following parameters:

i) the stiffness and the weight per unit length of the strand, ii) the theoretical zero tension length, iii) said initial displacements, iv) the tension measured in the strand, and v) said distance variation, and the strand is locked when the stretch remaining to be applied is equal to zero.

It may then be preferable if said expression is also defined by a value representing the insertion of the keys by which said strand is anchored to its cable anchor.

In the second embodiment, said expression which is a function of said predetermined parameter can define the locking tension that said strand must reach before it can be anchored.

In this case, said expression is defined by the following parameters:

i) the stiffness and the weight per unit length of the strand, ii) the theoretical zero tension length, iii) said initial displacements, iv) said distance variation, and the strand is locked when the measured value of the tension applied to said strand becomes equal to that of the tension calculated in this way.

According to other features of the method applying to both embodiments as defined above:

said initial displacements are measured on the structure by a procedure taking account of the construction tolerances of said structure or are determined from the results of design computations for the structure;

the cable includes a protective sheath and the method further consists of:

i) determining the theoretical zero tension length from the weight per unit length of said sheath, and ii) during the computation relating to said condition for ending tensioning, increasing the weight per unit length of the strand being tensioned by a fraction of the weight per unit length of the sheath;

the method also consists of taking account of the temperature of the strand being tensioned during step c) in the computation relating to said condition for ending tensioning;

the method also consists of taking account of the temperatures of the cables already installed on the structure and of the structure itself during step b) in the determination of said initial displacements.

BRIEF DESCRIPTION OF THE DRAWINGS

Other features and advantages of the present invention will become apparent in the course of the following description, which is given by way of example only and with reference to the accompanying drawings, in which.

DETAILED DESCRIPTION OF THE INVENTION

The following description of a preferred embodiment of a method according to the invention relates to a structure on which cables must be installed that takes the form of a suspension bridge whose supported deck is constructed by successive cantilevering, a situation in which the method is particularly beneficial. Nevertheless, it is expressly specified here that the method is not limited to this particular situation and that any structure involving the installation and tensioning of multiple strand cables may constitute an application of a method according to the invention.

Figure 1:
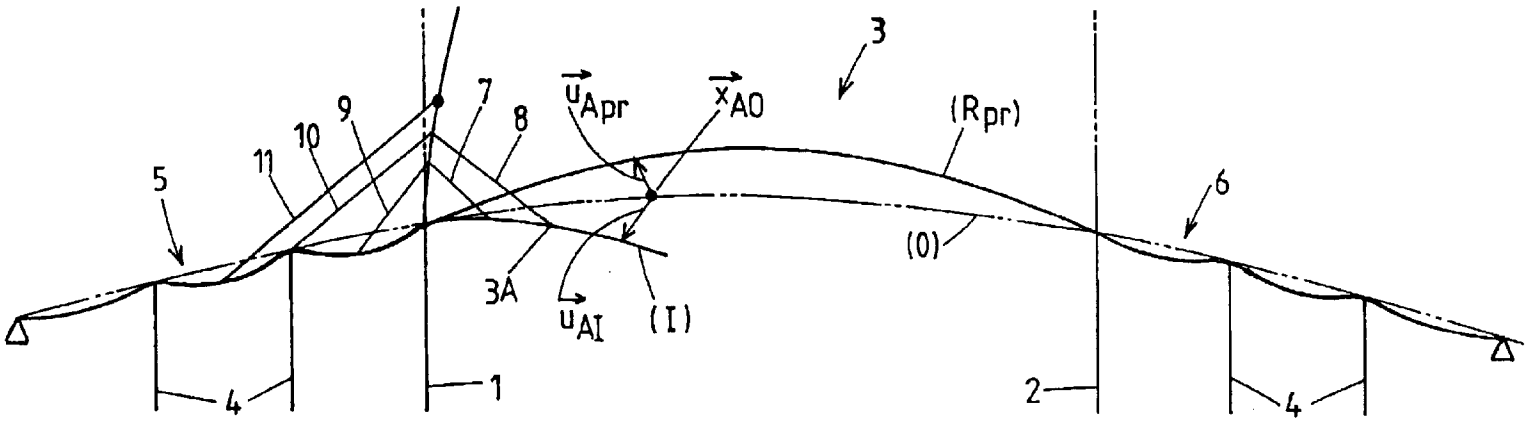
FIG. 1 is a diagram explaining how various concepts used during the execution of a tensioning method according to the invention are defined.

The FIG. 1 diagram shows from the side a symmetrical suspension bridge comprising two pylons 1 and 2 and a deck 3 which rests on piles 4 in the lateral spans 5 and 6. In the central span, i.e. between the two pylons, the deck 3 is constructed by successive cantilevering, and the lateral spans 5 and 6 can be constructed in parallel with the construction of the central span, using the same technique, or constructed beforehand, using a different method (on an arch, timed shifting). Be this as it may, and without compromising the general applicability of the invention, the examples concern the tensioning of a central span cable, all the cables anchored to a pylon being installed in a quasisymmetrical fashion to guarantee the stability of the pylon. The diagram shows a few cables 7, 8, 9, 10 and 11.

The portion 3A of the central span is deformed by its own weight, by the action of the cables that support it, and by the effect of any site loads (mobile crews, plant, handling machinery, etc.). The deformation is greatly exaggerated in FIG. 1, of course.

It is assumed that during the next phase of the construction of the structure a new cable 12 (not shown in FIG. 1) is to be installed alongside the cable 8 and tensioned using a method according to the invention.

The following description of a tensioning method refers to the concept of "displacement" used by persons skilled in this art. In this context, the "displacement" of a point M of a structure in a given state is equal to a vector $\overrightarrow{P_0P}$, where $P_0$ is the position of the point M in an original state of the structure and P is the position of the point M in the state under consideration.

In the context of computing expressions operative in the condition for terminating tensioning a strand in a method according to the invention, any convention can be adopted as to the definition of the origin of the displacement of a cable anchor; once defined, that origin then applies throughout the computation process.

The following description of a method according to the invention also refers to the concept of the "zero tension length" of a cable or strand, which theoretically characterizes the tension in an installed cable. The zero tension length L of an installed strand is defined as the length that that strand would have if it were cut at its cable anchors and measured when held straight with negligible tension. It is because the zero tension length L of a cable is less than the straight line distance d between its cable anchors that the cable can develop a tension T, which has a vertical component V balancing the weight of the corresponding section of deck. By judiciously choosing the zero tension length of each cable of a structure, the structure is tensioned so that the loads on it during construction and in service remain permissible, even if this means repeating the tensioning at certain phases of construction. As already indicated, the strand is tensioned by pulling on its end adjacent the active cable anchor A by means of a jack 15 (see FIG. 2): any stretching of the strand $\Delta l$ by the jack produces a corresponding reduction $\Delta l$ of its zero tension length L.

FIG. 1 shows some of the basic concepts that apply to the embodiment to be described of a method according to the invention:

the profile (O) represented in chain-dotted line is the profile of the structure from which the displacements are measured;

the profile ($R_{pr}$) represented in full line is the profile associated with a predetermined reference phase; the reference state defines the required tension in the cable at the end of the tensioning operation; at this stage no attempt is made to achieve a given tension, which would then be dependent on site loads, whose intensity and position cannot be predicted accurately beforehand; to the contrary, the computations effected by the computer employed for this purpose seek to impose a tension in the cable such that if, in the reference state, the cable anchors actually have the displacements predicted by the design computations, then the tension in the cable in said reference state is also that predicted by the design computations. It is important to note that the values, relating to the reference state, of the tension in the cable and the displacements of the cable anchors taken into account in the computations, are theoretical values taken directly from the design computations, and therefore constitute, as it were, specifications imposed on the on-site construction work by the designers;

the profile (l) represented in full line is associated with the phase of measuring the initial displacements of the cable anchors;

$\vec{\mu}A_{pr}$ is the displacement of the bottom cable anchor A considered in the predetermined reference phase;

$\vec{\mu}A_1$ is the initial displacement of the cable anchor A;

$\vec{\chi}A_0$ is the position vector $\overrightarrow{OA_0}$ of the cable anchor A from which the displacements are measured, O designating the origin of the system of axes Oxyz relative to which the structure is described.

Of course, analogous vectors $\vec{\mu}B_{pr}$, $\vec{\mu}B_1$ and $\vec{\chi}B_0$ are assigned to the top cable anchor B.

Figure 2:
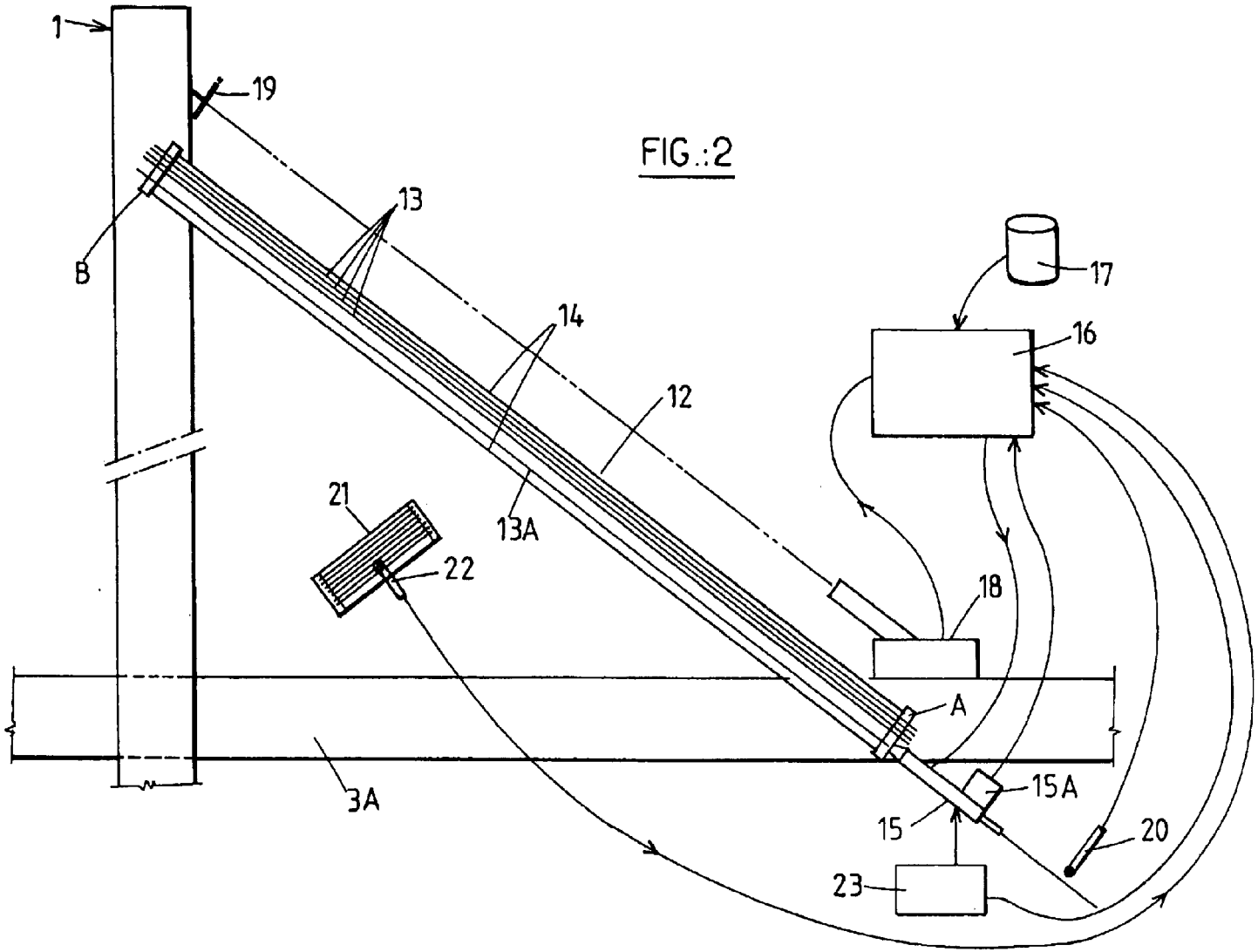
FIG. 2 is a highly simplified representation of an installation for tensioning a cable.

From now on the description refers to FIG. 2, which shows the cable 12 in profile during its installation between its two cable anchors A and B, respectively on the deck portion 3A and the pylon 1. The structure of these cable anchors can be that described in the French patent previously cited. The cable anchor A is that incorporating the anchor jaws or keys by means of which the active end of each strand is attached to the cable anchor. The top cable anchor B is "passive".

The cable 12, and all the other cables already installed or yet to be installed, comprise a plurality of strands 13, the number of which, in practice, routinely varies from 30 to 80, for example, and their length can be 250 meters or more. Moreover, in the embodiment described, each cable has a protective sheath 14 surrounding all the strands 13. The sheath 14 is disposed between the cable anchors A and B at the same time as installing the strand that will be tensioned first for the cable concerned, but is not fixed to them. The sheath is therefore threaded over the first strand and all the other strands of the same cable are then threaded into the sheath before they are anchored.

In some structures, however, it is possible to dispense with a sheath around the strands provided that they are sufficiently protected individually against the risks of corrosion.

In FIG. 2, four strands 13 have already been installed and tensioned and a fifth strand 13A has been threaded into the sheath 14 and anchored to the top cable anchor B and is therefore in the process of being tensioned.

To this end, a tensioning jack 15 known in the art is mounted temporarily on the strand 13A. The jack is associated with a sensor 15A for measuring the traction force that it applies to the strand 13A.

The device for implementing this method according to the invention includes, in addition to the jack 15, a microcomputer 16 storing in the form of files in a permanent memory 17 all the data concerning the cables to be installed on the structure.

According to the invention, the microcomputer 16 is connected to the sensor 15A of the jack 15 and also to means for measuring the distance between the cable anchors A and B adapted to measure the variation in the distance between them as each strand 13, 13A is tensioned. In the situation represented, the measuring means comprise a laser rangefinder 18 fixed to the structure near the cable anchor A and a reflector 19 which reflects the measuring laser beam emitted by the rangefinder 18. These rangefinders are well known to the person skilled in the art.

The microcomputer 16 is also connected to a temperature sensor 20 for measuring the temperature of the strand being tensioned. The microcomputer 16 is further connected to another sensor 22 which measures the temperature inside a witness cable section 21. This witness section, consisting of a bundle of strands and a sheath member surrounding them, is suspended or otherwise disposed above the deck portion 3A in the vicinity of the cables already installed. This means that the temperature inside the sheath of the cables already installed can be determined without having to pierce the sheath to insert a sensor.

Figure 3:
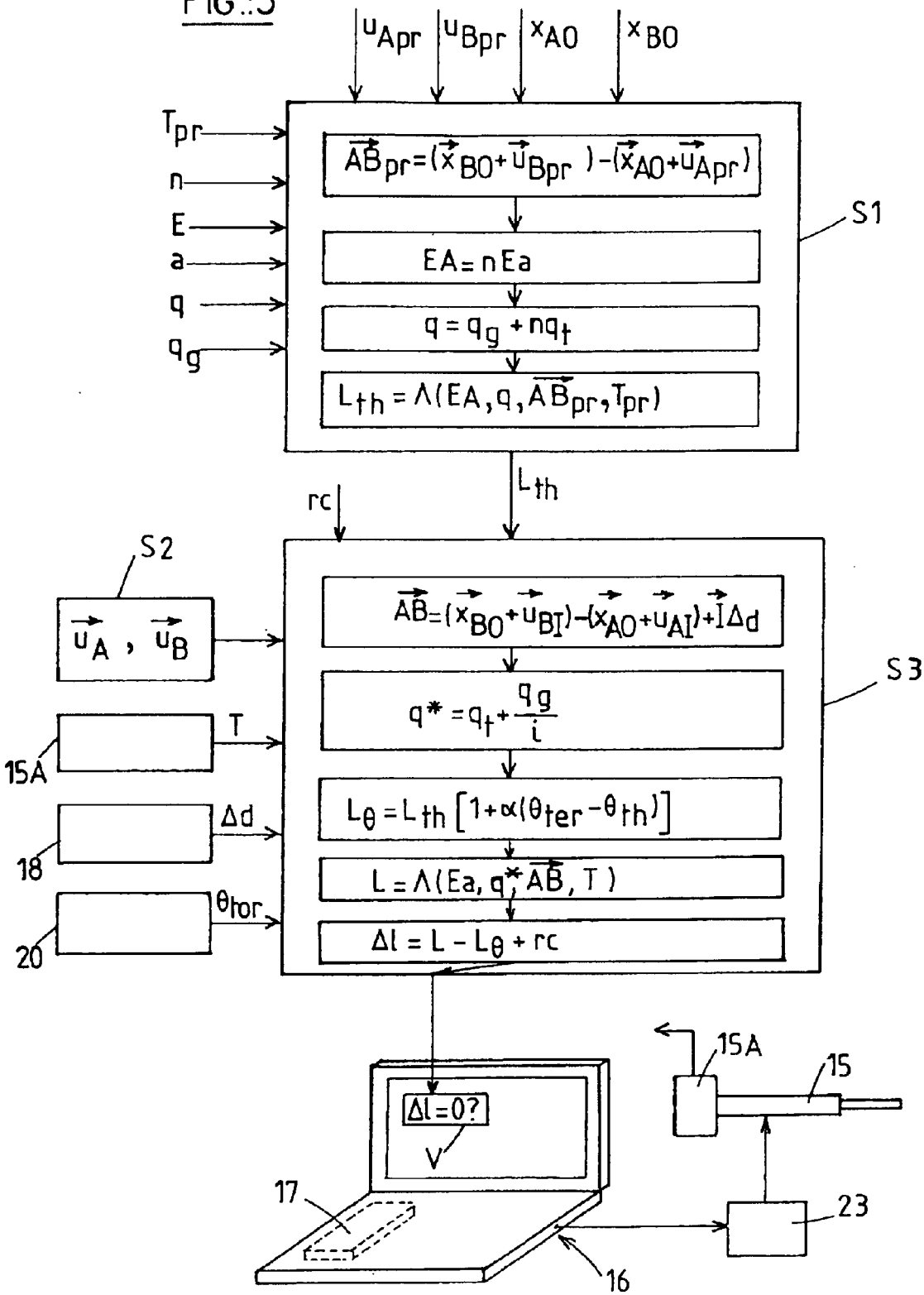
FIG. 3 is a flowchart showing computation steps of a first embodiment of a method according to the invention.

Referring from now on to FIG. 3, the computation algorithm used by the microcomputer 16 to execute a first embodiment of a method according to the invention using data supplied to it by the tension sensor 15A, the permanent memory 17, the rangefinder 18 and the temperature sensor 20 is described. It is assumed that, using an appropriate topographical procedure, it has been possible to measure on site the effective values of the displacements $\vec{\mu}A_r$ and $\vec{\mu}B_t$ of the cable anchors, just before installing the first strand. If this is not the case, it is always possible to use theoretical values of these displacements taken into account in the design process for this phase, provided that the predicted loading is rigorously respected on site and these values are corrected by means of a computer, the corrections being necessary because the temperatures of the structure and the cables already installed generally differ from the theoretical values taken into account during the design computations (whence the benefit in this situation of the temperature sensor 22).

In the context of this first embodiment, it is assumed that the condition for ending tensioning of the strand is expressed by taking as a control parameter the remaining stretch $\Delta l$ to be applied to the strand: pulling on the active end of the strand ceases when this stretch becomes equal to zero.

However, another embodiment is described hereinafter in which the control parameter is the tension indicated by the sensor 15A; in this case, the condition for ending tensioning of the strand is reached when the tension in the strand being installed reaches a particular blocking value computed by the microcomputer 16 as a function of measurements and stored data.

Note, however, that the first embodiment has the advantage that it can take directly into account in the tensioning procedure the systematic relaxation effect that is a feature of some other devices when the tensioning jack 15 is released, known to persons skilled in the art as "key entry".

However, regardless of the method chosen, at the end of the design process data is available for computing the theoretical value of the zero tension length $L_{th}$ of each cable to be installed. The computation is based on the following data (see FIGS. 3 and 4, step S1):

- the theoretical positions $\vec{\chi}A_0$ and $\vec{\chi}B_0$ of the cable anchors A and B from which the displacements are measured,
- the theoretical values, obtained from the design computations, of the tension $T_{pr}$ of the cable and the displacements $\vec{\mu}A_{pr}$ and $\vec{\mu}B_{pr}$ of its cable anchors A and B for the predetermined reference phase,
- the axial stiffness EA of the cable, obtained by multiplying the number of strands n constituting the cable by the apparent Young's modulus E of a strand and by the section a of a strand: EA=nEa
- the weight per unit length q of the cable, given by the equation $q=q_g+nq_t$, $q_g$, where q represents the weight per unit length of the sheath 14 and $q_t$ the unit length of a strand.

To compute the value of $L_{th}$, it is necessary to solve the following applied mechanics problem: "Given two points A and B in space whose relative position is characterized by the vector $\overrightarrow{AB}=\overrightarrow{AB}_{pr}=(\vec{\chi}B_0+\vec{\mu}B_{pr})-(\vec{\chi}A_0+\vec{\mu}A_{pr})$ axial stiffness EA and of weight per unit length q, determine the untensioned length L of said cable so that, once anchored at A and B, it exerts at the point A a force equal to a given value $T_A$". The classical elastic chain theoretical model is used to establish the equations needed to solve this problem. This model is described in "Cable Structures" by H. Max Irvine, published in 1981 by The MIT Press Series in Structural Mechanics, pages 16 to 20. Symbolically, the theoretical zero tension length $L_{th}$ of the cable is a function of EA, q, $\overrightarrow{AB}_{pr}$ and $T_{pr}$:

$$L_{th}=\Lambda(EA,\ q,\ \overrightarrow{AB}_{pr},\ T_{pr})$$

In both embodiments, the method of tensioning a cable begins with the determination of the initial displacements $\vec{\mu}A_r$ and $\vec{\mu}B_t$ of the cable anchors (see FIGS. 3 and 4, step S2), which can essentially be obtained in two ways:

- either they are measured on the structure by methods known in the art of geometrical tracking of the pylon 1 and the deck 3A,
- or they are estimated from corresponding theoretical values extracted from the design computations and stored in the permanent memory 17.

In the latter case, a real load must be imposed on the structure that is as close as possible to that used in the design computations, in particular with regard to site loads (plant, lifting machinery, etc.). Moreover, in this case, the raw theoretical values must be corrected to take account of the fact that neither the cables already installed nor the remainder of the structure is at the uniform construction temperature used in the design computations. The corrective computation is effected by reading a value representative of the temperature of all of the installed cables by means of the sensor 22 and entering an average value for the temperature of the remainder of the structure; the computer 16 then carries out the necessary computations based on unitary thermal load situations determined during the design computations and stored in the permanent memory 17.

In the following description, only this first situation is considered, and applied to both of the embodiments described.

Once the initial displacements of the cable anchors have been determined in step S2, there follows the threading and tensioning of each of the strands of the cable.

The following operations of the method according to the invention are executed each time that a strand 13 is tensioned.

In a first embodiment shown in FIG. 3, during tensioning (for example of the strand 13A), the computer 16 executes repetitively (in step S3, for example at intervals of one second) a computation to determine the stretch $\Delta l$ that remains to apply to the strand 13A before the jack 15 is released and the strand 13A is anchored by inserting the keys into the cable anchor. The data that has to be measured or determined on site for this computation comprises:

- the initial displacements $\vec{\mu}A_t$ and $\vec{\mu}B_t$ previously determined (step S2),
- the tension T in the strand measured by means of the sensor 15A,
- the variation $\Delta d$ of the straight line distance between the cable anchors A and B measured using the rangefinder 18, the origin of Δd being taken at the time when the initial displacements are determined, i.e. just before threading the first strand 13, the temperature $\theta_{tor}$ of the strand 13A measured by the sensor 20, the insertion of the keys rc.

As tensioning proceeds, the stretch Δl remaining to be applied to the strand 13A is displayed on the screen of the microcomputer 16 and a signal can be sent to an automaton 23 controlling the jack 15 to release the latter as soon as Δl reaches the value zero, allowing for the insertion of the keys rc.

At a given moment in tensioning the strand 13A, its zero tension length L is obtained from a function analogous to that used to compute the theoretical length previously described:

$$L=\Lambda(Ea,\ q^*,\ \overrightarrow{AB},\ T)$$

where:

Ea is the axial stiffness of the strand, q* is the weight per unit length $q_t$ of the strand weighted by the contribution of the strand to supporting the weight per unit length $q_g$ of the sheath 14:

$$q^*=q_t+q_g/i \text{ (} i \text{ is the number of the strand)}$$

$\overrightarrow{AB}$ represents the relative position of the cable anchors, if they were perfectly installed:

$$\overrightarrow{AB}=(\vec{\chi}B_0+\vec{\mu}B_1)-(\vec{\chi}A_0+\vec{\mu}A_1)+\vec{I}\Delta d$$

where $\vec{I}$ is the unit vector linking the cable anchors A and B.

The zero tension length $L_\theta$, the objective to be achieved at the end of the tensioning operation, at a temperature $\theta_{tor}$, has the value:

$$L_\theta=L_{th}[1+\square(\theta_{tor}-\theta_{th})]$$

where designates the coefficient of expansion of the strand.

The stretch Δl remaining to be applied to the strand 13A before releasing the jack 15 is finally given by the equation:

$$\Delta l=L-L_\theta+rc$$

in which rc designates the insertion of the keys (which is of the order of 4 to 7 mm in practice).

The strand 13A is then anchored permanently in the cable anchor A and the jack 15 is detached from it so that it can be used for the next strand 13.

Figure 4:
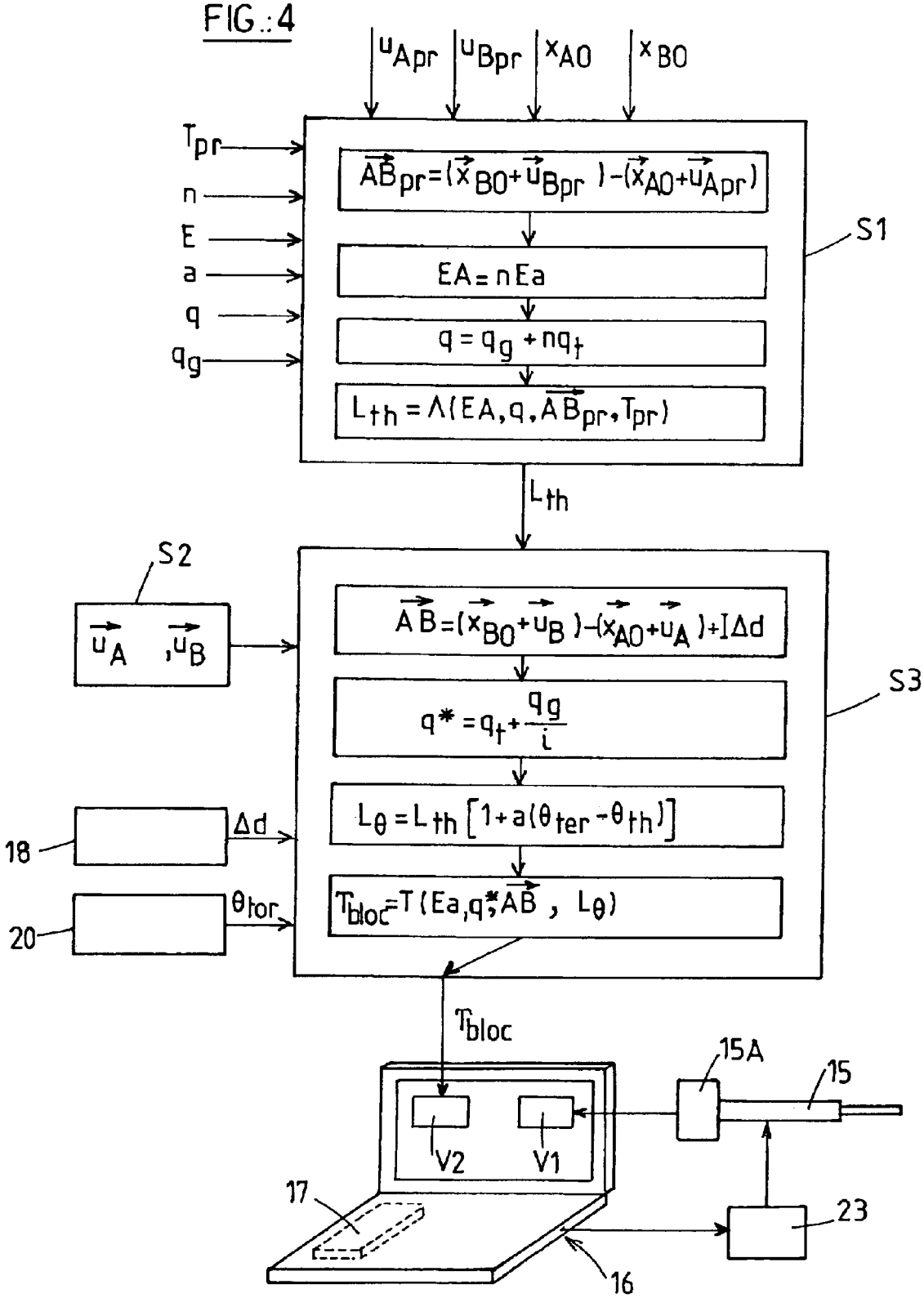
FIG. 4 is a flowchart showing computation steps of a second embodiment of a method according to the invention.

As shown in FIG. 4, in a second embodiment of the invention, steps S1 and S2 are executed in the same way as in the first embodiment.

The second embodiment differs in the step S3, during which, instead of computing the stretch value Δl, a value T is computed representing the locking tension to be achieved in the strand 13A before anchoring can take place.

The locking tension $T_{bloc}$ is determined from the values $\overrightarrow{AB}$, q* and $L_\theta$ using the following equation:

$$T_{bloc}=T(Ea,q^*,\overrightarrow{AB},L_\theta)$$

Note that the determination of the function T above can use the same elastic chain theory as described in the work previously cited, the problem to be solved being based on looking for the value T rather than the value of L.

The value of the locking tension $T_{bloc}$ computed by the computer 16 is displayed in a window V2 of the screen and the real value of the tension in the strand 13A measured by means of the sensor 15A is displayed simultaneously in another window V1. Locking is effected as soon as the values in the windows V1 and V2 are equal. The process can be stopped automatically by the automaton 23 as soon as the condition of equality applies.

Figure 5:
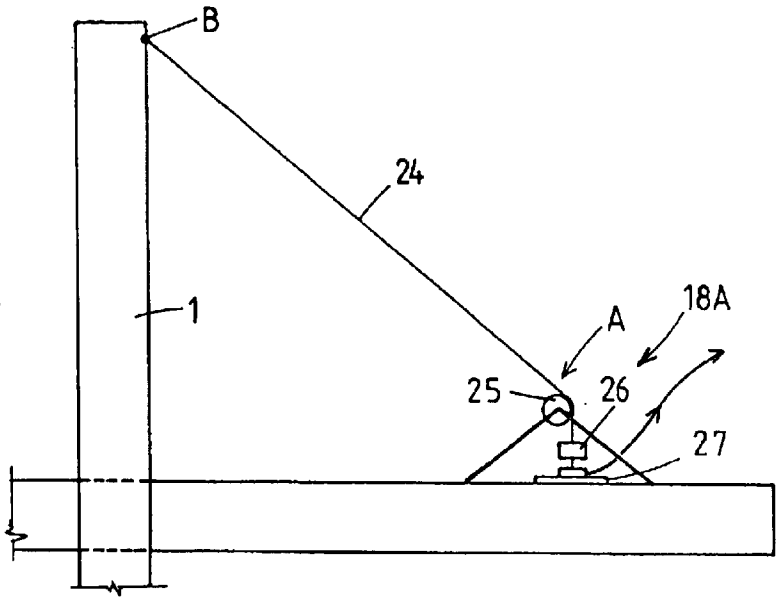
FIG. 5 shows one embodiment of apparatus for measuring the variation in the distance between cable anchors that can be used in a method according to the invention.

FIG. 5 shows a variant of the rangefinder 18A for measuring the variation of the distance between the cable anchors A and B and which can also be used to execute the method according to the invention. In this case, an Invar® wire 24, for example, is fixed at one end to the pylon 1 in the vicinity of the top cable anchor B. The other end of the wire 24 passes over a pulley 25 mounted in the vicinity of the bottom cable anchor A and is attached to a weight 26. An electronic comparator 27 on the portion 3A of the deck under construction measures the variation of the vertical position of the weight 26 in order to deduce therefrom the variation in the distance between the cable anchors A and B.

Other variants can be considered of the device used to measure the distance variation between the cable anchors A and B. Thus using an optonumerical system enables the evolution of the distance between a target and the instrument to be determined by means of digital imaging processing in real time.

What is claimed is:

1. A method of tensioning a multiple strand cable in which said strands are installed one after the other between two cable anchors fastened to a structure, the method comprising the steps of:

pulling on one end of a strand from one of the cable anchors with the other end fixed to the other cable anchor, measuring continuously the value of the tension in the strand, and continuously testing a condition for ending tensioning for the strand, said condition employing an expression that is a function of a predetermined parameter, wherein said predetermined parameter is the variation in the distance between said cable anchors.

2. A tensioning method according to claim 1, further comprising the steps of:

a) determining the theoretical value of the zero tension length of the cable as a function of:

the total number of strands of the cable, the axial stiffness and the weight per unit length of each of the strands of the cable, the theoretical position of the cable anchors as defined by drawings of the structure, the tension in the cable and the displacements of the cable anchors predicted by design computations for the structure for a predetermined reference phase occurring after tensioning the cable, b) evaluating the initial displacements of the cable anchors immediately before installing the first strand of the cable, c) during the tensioning of each strand of the cable:

measuring continuously a distance variation from step b), executing a computation loop to test continuously the condition for ending tensioning the strand, using said expression which is a function of said predetermined parameter, and d) locking the strand being tensioned to the cable anchor as soon as the condition for ending tensioning of the strand is satisfied.

3. A tensioning method according to claim 2, wherein said expression which is a function of said predetermined parameter defines the stretch remaining to be applied to the strand until the condition for ending tensioning is satisfied.

4. A tensioning method according to claim 3, wherein said expression is defined by the following parameters:

i) the stiffness and the weight per unit length of the strand, ii) the theoretical zero tension length, iii) said initial displacements, iv) the tension measured in the strand, and v) said distance variation, and in that the strand is locked when the stretch remaining to be applied is equal to zero.

5. A tensioning method according to claim 4, wherein said expression is also defined by a value representing an insertion of keys by which said strand is anchored to its cable anchor.

6. A tensioning method according to claim 2, wherein said expression which is a function of said predetermined parameter defines the locking tension that said strand must reach before it can be anchored.

7. A tensioning method according to claim 6, wherein said expression is defined by the following parameters:

i) the stiffness and the weight per unit length of the strand, ii) the theoretical zero tension length, iii) said initial displacements, iv) said distance variation, and wherein the strand is locked when the measured value of the tension applied to said strand becomes equal to that of the tension calculated in this way.

8. A method according to claim 2, wherein said initial displacements are measured on the structure by a procedure which factors in construction tolerances of said structure.

9. A tensioning method according to claim 2, wherein said initial displacements are determined from the results of design computations for the structure.

10. A tensioning method according to claim 2, wherein the cable includes a protective sheath and the method further comprises:

i) determining the theoretical zero tension length from the weight per unit length of said sheath, and ii) during the computation relating to said condition for ending tensioning, increasing the weight per unit length of the strand being tensioned by a fraction of the weight per unit length of the sheath.

11. A tensioning method according to claim 2, further comprising factoring in the temperature of the strand being tensioned during step c) in the computation relating to said condition for ending tensioning.

12. A tensioning method according to claim 2, further comprising factoring in the temperatures of the cables already installed on the structure and of the structure itself during step b) in the determination of said initial displacements.

* * * * *